US008989621B2

(12) United States Patent
Hattori et al.

(10) Patent No.: US 8,989,621 B2
(45) Date of Patent: Mar. 24, 2015

(54) DEVELOPMENT DEVICE, AND PROCESS CARTRIDGE AND IMAGE FORMING APPARATUS INCLUDING SAME

(75) Inventors: Yoshio Hattori, Kanagawa (JP); Toshio Koike, Tokyo (JP); Hiroaki Okamoto, Kanagawa (JP); Atsushi Nakamoto, Kanagawa (JP); Yoshiyuki Fukuda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 13/555,872

(22) Filed: Jul. 23, 2012

(65) Prior Publication Data

US 2013/0034368 A1 Feb. 7, 2013

(30) Foreign Application Priority Data

Aug. 1, 2011 (JP) ..... 2011-168040

(51) Int. Cl.
*G03G 15/08* (2006.01)

(52) U.S. Cl.
CPC ..... *G03G 15/0881* (2013.01); *G03G 15/0882* (2013.01); *G03G 2215/0877* (2013.01); *G03G 2215/088* (2013.01); *G03G 15/0891* (2013.01)
USPC ..... 399/103; 399/119

(58) Field of Classification Search
CPC ..... G03G 15/080881; G03G 15/0882; G03G 2215/0877; G03G 2215/088; G03G 15/0881
USPC ..... 399/102, 103, 106
See application file for complete search history.

(56) References Cited

U.S. PATENT DOCUMENTS

| | | | | |
|---|---|---|---|---|
| 5,749,026 | A * | 5/1998 | Goldie | 399/103 |
| 7,813,680 | B2 | 10/2010 | Masuda et al. | |
| 8,023,855 | B2 | 9/2011 | Hattori et al. | |
| 2008/0085137 | A1 | 4/2008 | Suzuki | |
| 2009/0136257 | A1 | 5/2009 | Hattori et al. | |
| 2009/0238610 | A1* | 9/2009 | Miyoshi et al. | 399/267 |
| 2009/0245887 | A1 | 10/2009 | Masuda et al. | |

(Continued)

FOREIGN PATENT DOCUMENTS

| | | |
|---|---|---|
| JP | 5-333691 | 12/1993 |
| JP | 11-174810 | 7/1999 |

(Continued)

*Primary Examiner* — Benjamin Schmitt
(74) *Attorney, Agent, or Firm* — Harness, Dickey & Pierce

(57) ABSTRACT

A development device includes a development casing for containing two-component developer, a developer bearer, a developer regulator to adjust an amount of developer carried on the developer bearer, a first developer conveyance member to supply developer to the developer bearer, a second developer conveyance member to transport axially developer separated from the developer bearer, first and second conveyance channels divided by a partition, in which the first and second developer conveyance members are respectively provided, and a removable sheet member to cover the developer bearer in an area facing the developer regulator, the first and second conveyance channels, and the partition. A first end portion of the sheet member extends from the second conveyance channel outside the development casing through a through hole formed in the development casing, and a second end portion thereof is retained by a retainer at a position outside the developer regulator.

18 Claims, 5 Drawing Sheets

(56) References Cited

U.S. PATENT DOCUMENTS

| | | | |
|---|---|---|---|
| 2010/0202805 | A1 | 8/2010 | Miyoshi et al. |
| 2011/0008073 | A1 | 1/2011 | Kudo et al. |
| 2011/0058858 | A1 | 3/2011 | Fukuda et al. |
| 2011/0129262 | A1 | 6/2011 | Nakamoto |
| 2011/0150525 | A1 | 6/2011 | Fujiwara et al. |
| 2011/0217085 | A1 | 9/2011 | Hattori et al. |
| 2012/0163874 | A1 | 6/2012 | Hattori et al. |

FOREIGN PATENT DOCUMENTS

| | | | |
|---|---|---|---|
| JP | 2002-268353 | | 9/2002 |
| JP | 2002-372862 | | 12/2002 |
| JP | 2003-323043 | | 11/2003 |
| JP | 4003411 | B2 | 11/2007 |
| JP | 2008-026408 | | 2/2008 |
| JP | 2009-192554 | A | 8/2009 |
| JP | 2009-192962 | A | 8/2009 |
| JP | 2010-197539 | A | 9/2010 |

* cited by examiner

DEVELOPMENT DEVICE, AND PROCESS CARTRIDGE AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2011-168040, filed on Aug. 1, 2011, in the Japan Patent Office, the entire disclosure of which is hereby incorporated by reference herein.

FIELD OF THE INVENTION

The present invention generally relates to an image forming apparatus such as a photocopier, a facsimile machine, a printer, or a multifunction machine having several of those capabilities, and a development device and a process cartridge incorporated therein.

BACKGROUND OF THE INVENTION

Two-component developer consisting essentially of toner particles and carrier particles is widely used in image forming apparatuses such as photocopiers, facsimile machines, printers, or multifunction machines having several of those capabilities. Two-component development devices typically include a development roller (i.e., a developer bearer), multiple developer conveyance members to transport developer in the longitudinal direction of the development device, thereby forming a developer circulation channel, and a developer regulator to adjust the amount of developer carried on the development roller upstream from a development range where the development roller faces an image bearer (e.g., a photoreceptor).

Fresh toner is supplied to the two-component development device as the toner inside the development device is consumed in image development. The supplied toner is mixed with the developer in the development device by the developer conveyance member (e.g., conveyance screw), and then the mixed developer is partly supplied to the development roller. While the development roller rotates, the developer regulator (e.g., a doctor blade) disposed facing the development roller adjusts the amount of the developer carried on the development roller, and then the toner in the two-component developer adheres to a latent image formed on the image bearer in the development range.

Typically, at least two developer conveyance members (i.e., first and second conveyance members) are arranged vertically. For example, the first conveyance member (lower conveyance member) serves as a supply screw and supplies developer onto the development roller at a position corresponding to an attraction magnetic pole generated by a magnet roller provided inside the development roller while transporting the developer longitudinally. The second conveyance member (upper conveyance member) serves as a collecting screw and transports the developer separated from the development roller in the direction opposite the direction in which the first conveyance member transports the developer (hereinafter "developer circulation direction).

Developer conveyance channels (first and second conveyance channels) in which the first and the second conveyance members are respectively provided are separated from each other, at least partly, by a partition to prevent the developer from moving to the other conveyance, but can communicate with each other through communication portions in axial end portions. An end of the partition faces the development roller and adjacent to the development roller. The developer is conveyed upward from a downstream end portion of the first conveyance channel to the second conveyance channel and falls under its own weight from a downstream end portion of the second conveyance channel to the first conveyance channel. The developer regulator may be disposed above the development roller.

Arranging the multiple developer conveyance members vertically is widely used in tandem multicolor image forming apparatuses in which multiple development devices are arranged horizontally because this arrangement can make the development device horizontally compact. Compared with an arrangement in which multiple conveyance members are arranged in parallel horizontally, this arrangement can better inhibit the developer that has been used in image development from being supplied to the developer bearer, thus reducing unevenness in image density.

Developer is typically contained in the development device before shipment. To prevent developer from scattering from the development device or adhering to the development roller during transport or storage, various approaches have been tried.

For example, JP-2002-268353-A and JP-4003411-B propose a seal member for separating the development roller from an interior of the development device, that is, a developer containing chamber for containing developer. The seal member is removed before the development device is used at the site of users.

In configurations in which the multiple developer conveyance members are arranged vertically, the area in which the developer bearer faces the developer containing chamber (i.e., first and second conveyance channels) is relatively large, and it is difficult to provide such a seal member.

BRIEF SUMMARY OF THE INVENTION

In view of the foregoing, one embodiment of the present invention provides a development device to develop a latent image formed on a latent image bearer with two-component developer including toner and carrier. The development device includes a development casing for containing developer, a developer bearer disposed facing the latent image bearer through an opening formed in the development casing and configured to carry by rotation developer to a development range facing the latent image bearer, a developer regulator disposed facing the developer bearer to adjust an amount of developer carried on the developer bearer, a first developer conveyance member disposed facing the developer bearer to supply developer to the developer bearer while transporting the developer axially inside the development casing, a second developer conveyance member disposed facing the developer bearer to transport axially developer separated from the developer bearer, and a partition disposed facing the developer bearer. The partition divides an interior of the development casing into first and second conveyance channels in which the first and second developer conveyance members are respectively provided, thus forming a developer circulation channel. The first and second conveyance channels are disposed facing the developer bearer and extend in an axial direction of the developer bearer. The development device further includes a sheet member removably installable inside the development casing and a retainer for the sheet member. The sheet member covers a surface of the developer bearer in an area facing the developer regulator, the first and second conveyance channels, and the partition. A first end portion of the sheet member extends from a position facing the second conveyance channel outside the development casing through a through hole formed in the development casing, and a second end portion of the sheet member extends from a position facing the developer regulator and is retained by the retainer at a position outside the developer regulator.

Another embodiment provides a process cartridge that is removably installed in an image forming apparatus and includes a common unit casing in which at least the latent image bearer and the development device described above are housed.

Yet another embodiment provides an image forming apparatus that includes the image bearer and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
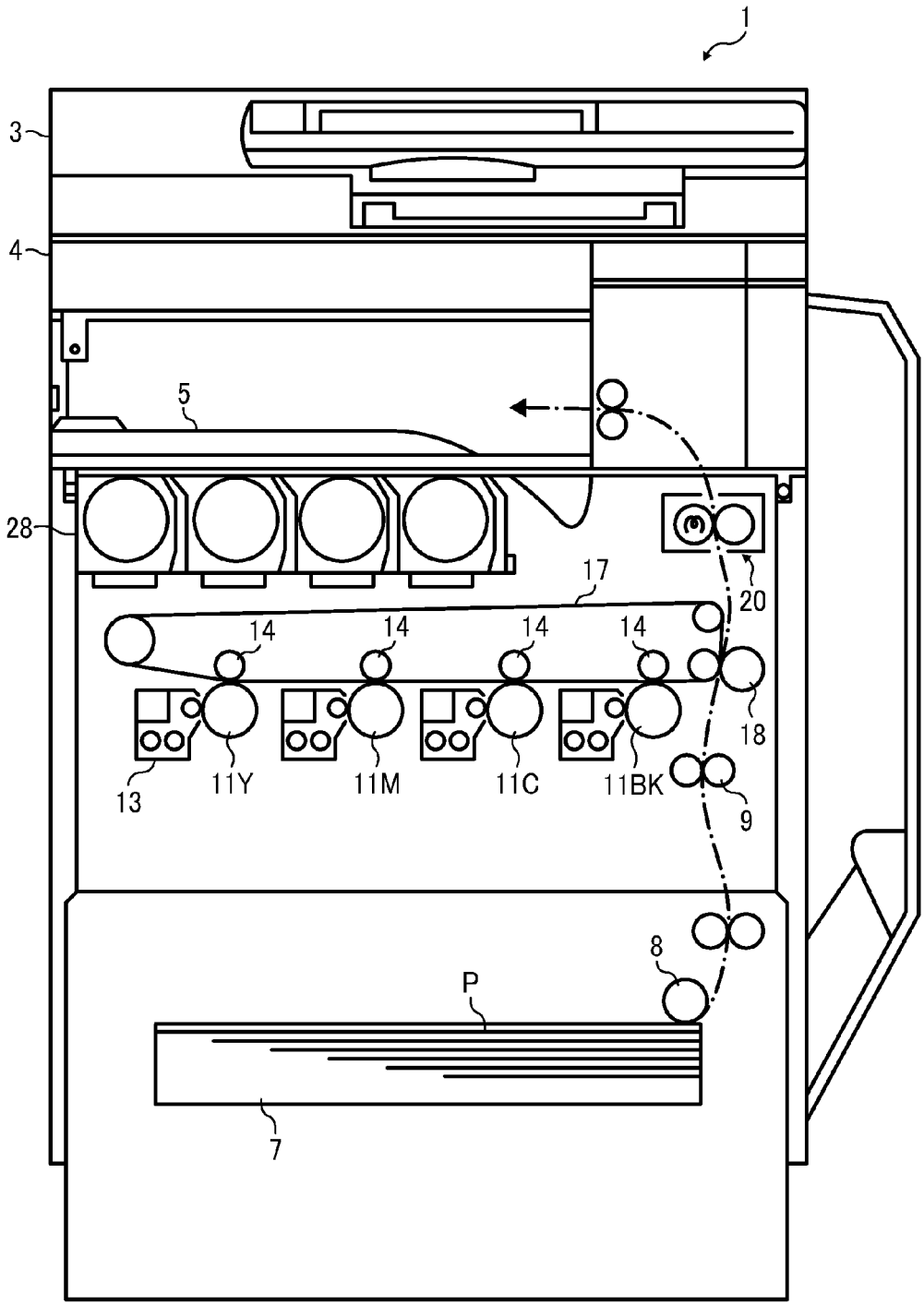
FIG. 1 is a schematic diagram illustrating a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

It is to be noted that the term "process cartridge" used in this specification means an integrated unit that is designed to be removably installed in a main body of the image forming apparatus and includes a latent image bearer and at least one of a charging unit, a development device, and a cleaning unit housed in a common unit casing.

FIG. 1 illustrates a configuration of an image forming apparatus 1 according to an embodiment.

In FIG. 1, reference numeral 3 represents a document feeder to send an original (i.e., an original document) to a document reading unit 4 that reads image data of the original, 5 represents a discharge tray on which output images are stacked, 7 represents a sheet cassette containing sheets P of recording media, 8 represents feed rollers, 9 represents a pair of registration rollers to adjust the timing to transport the sheet P, 11 represents photoreceptor drums serving as latent image bearers on which yellow, magenta, cyan, and black toner images are formed, respectively, 13 represents development devices to develop electrostatic latent images formed on the respective photoreceptor drums 11, and 14 represents transfer bias rollers or primary-transfer rollers to transfer toner images formed on the respective photoreceptor drums 11 onto an intermediate transfer belt 17.

Additionally, reference numeral 18 represents a secondary-transfer roller to transfer the superimposed toner image from the intermediate transfer belt 17 onto the sheet P, 20 represents a fixing device to fix the toner image on the sheet P, and 28 represents toner containers from which respective color toners are supplied to the development devices 13.

Figure 2:
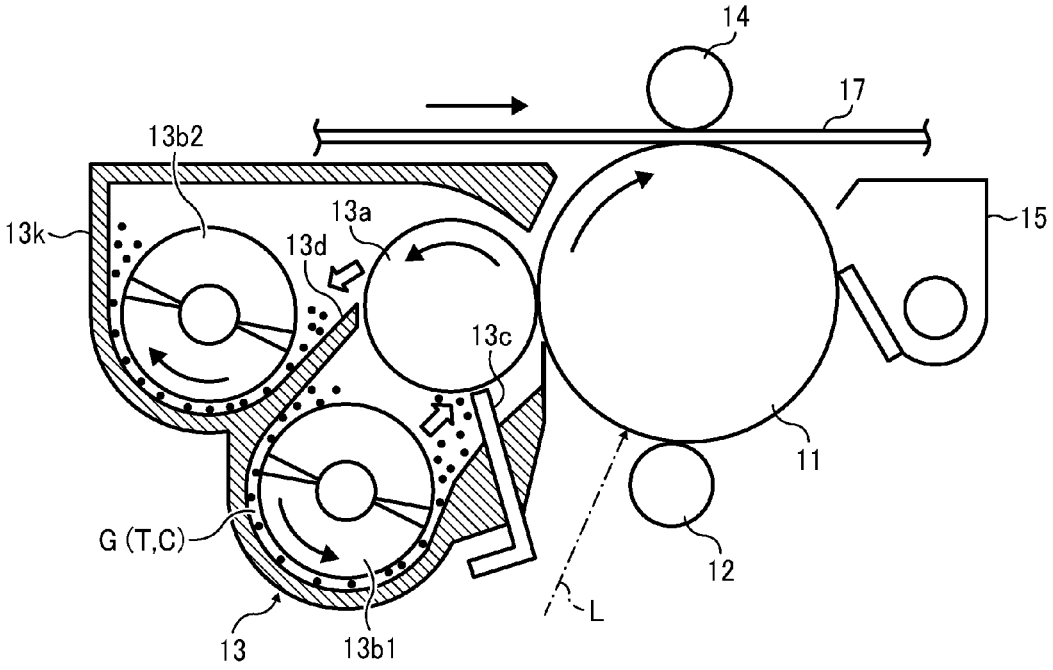
FIG. 2 is a schematic diagram illustrating a configuration of an image forming unit included in the image forming apparatus shown in FIG. 1.

Operations of the image forming apparatus 1 shown in FIG. 1 to form multicolor images are described below. It is to be noted that FIG. 2 is also referred to when image forming processes performed on the respective photoreceptor drums 11 are described.

Conveyance rollers provided in the document feeder 3 transport originals set on a document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via minors and lenses. The color sensor reads the multicolor image data of the original for each of decomposed colors of red, green, and blue (RGB), and converts the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to an exposure unit. The exposure unit directs laser beams L to surfaces of the respective photoreceptors 11 according to image data of respective colors.

Meanwhile, the four photoreceptor drums 11 rotate clockwise in FIG. 1. As shown in FIG. 2, the surface of the photoreceptor drum 11 is charged by a charging unit 12 (e.g., a charging roller) uniformly at a position facing the charging unit 12 (charging process). Thus, the surface of the photoreceptor drum 11 is charged to a predetermined electrical potential. When the surfaces of the photoreceptor drums 11 reach positions to receive the laser beams L, respectively, the exposure unit directs the laser beams L according to the respective color image data, emitted from four light sources (not shown), to the respective photoreceptor drums 11, which is referred to as an exposure process.

The four laser beams L pass through different optical paths for yellow, magenta, cyan, and black.

The laser beam L corresponding to the yellow component is directed to the photoreceptor drum 11Y that is the first from the left in FIG. 1 among the four photoreceptor drums 11. A polygon minor that rotates at high velocity deflects the laser beam L for yellow in a direction of a rotation axis of the photoreceptor drum 11Y (main scanning direction) so that the leaser beam L scans the surface of the photoreceptor drum 11Y. Thus, an electrostatic latent image for yellow is formed on the photoreceptor drum 11 charged by the charging unit 12.

Similarly, the laser beam L corresponding to the magenta component is directed to the surface of the photoreceptor drum 11M that is the second from the left in FIG. 1, thus forming an electrostatic latent image for magenta thereon. The laser beam L corresponding to the cyan component is directed to the surface of the photoreceptor drum 11C that is the third from the left in FIG. 1, thus forming an electrostatic latent image for cyan thereon. The laser beam L corresponding to the black component is directed to the surface of the photoreceptor drum 11BK that is the fourth from the left in FIG. 1, thus forming an electrostatic latent image for black thereon.

Then, each photoreceptor drum 11 reaches a position facing the development device 13, and the development device 13 supplies toner of the corresponding color to the photoreceptor drum 11. Thus, the latent images on the respective photoreceptor drums 11 are developed into different single-color toner images in a development process.

Subsequently, the surface of the photoreceptor drum 11 reaches a position facing the intermediate transfer belt 17, serving as an image bearer as well as an intermediate transfer member. The primary-transfer rollers 14 are provided in contact with an inner circumferential surface of the intermediate transfer belt 17 at the positions where the respective photoreceptor drums 11 face the intermediate transfer belt 17. At these positions, the toner images formed on the respective photoreceptor drums 11 are sequentially transferred and superimposed one on another on the intermediate transfer belt 17, forming a multicolor toner image thereon, in a primary transfer process.

After the primary transfer process, the surface of each photoreceptor drum 11 reaches a position facing the cleaning unit 15, which collects any toner remaining on the photoreceptor drum 11, which is hereinafter referred to as "untransferred toner" (cleaning process).

Additionally, the surface of each photoreceptor drum 11 passes through a discharge device, not shown, and thus a sequence of image forming processes performed on each photoreceptor drum 11 is completed.

Meanwhile, the surface of the intermediate transfer belt 17 carrying the superimposed toner image moves counterclockwise and reaches the position facing the secondary-transfer roller 18. The secondary-transfer roller 18 transfers the multicolor toner image from the intermediate transfer belt 17 onto the sheet P (secondary-transfer process).

Further, the surface of the intermediate transfer belt 17 reaches a position facing a belt cleaning unit. The belt cleaning unit collects any untransferred toner remaining on the intermediate transfer belt 17, and thus a sequence of transfer processes performed on the intermediate transfer belt 17 is completed.

The sheet P is transported from one of the sheet cassettes 7 via the registration rollers 9, and the like, to the secondary-transfer nip formed between the intermediate transfer belt 17 and the secondary-transfer bias roller 18.

More specifically, the feed roller 8 sends out the sheet P from the sheet cassette 7, and the sheet P is then guided by a sheet guide, not shown, to the registration rollers 9. The registration rollers 9 forward the sheet P to the secondary transfer nip, timed to coincide with the arrival of the multicolor toner image formed on the intermediate transfer belt 17.

Then, the sheet P carrying the multicolor image is transported to the fixing device 20. The fixing device 20 includes a fixing roller and a pressure roller pressing against each other, forming a nip therebetween, in which the multicolor image is fixed on the sheet P.

After the fixing process, a pair of discharge rollers discharges the sheet P as an output image to the discharge tray 5, provided outside the image forming apparatus 1. Thus, a sequence of image forming processes is completed.

Next, image forming units are described in further detail below.

FIG. 2 is a schematic diagram illustrating a configuration of an image forming unit.

It is to be noted that the subscripts Y, C, M, and BK are omitted in the drawings for simplicity because the image forming units have a similar configuration.

As shown in FIG. 2, each image forming unit includes the photoreceptor drum 11, the charging unit 12, the development device 13, the cleaning unit 15, and the like. At least two of the components of the image forming unit can be housed in a common unit casing, thus forming a process cartridge (modular unit) removably installed in the apparatus body. When the image forming unit is configured as such a process cartridge, maintenance work can be facilitated.

The photoreceptor drum 11 in the present embodiment is a negatively-charged organic photoreceptor having an external diameter of about 30 mm and is rotated counterclockwise in FIG. 2 by a driving unit, not shown.

For example, the charging unit 12 is an elastic charging roller and can be formed by covering a metal core with an elastic layer of moderate resistivity, such as foamed urethane layer, that includes carbon black as electroconductive particles, sulfuration agent, foaming agent, and the like. The material of the elastic layer of moderate resistivity include, but not limited to, rubber such as urethane, ethylene-propylene-diene (EPDM), acrylonitrile butadiene rubber (NBR), silicone rubber, and isoprene rubber to which electroconductive material such as carbon black or metal oxide is added to adjust the resistivity. Alternatively, foamed rubber including these materials may be used.

The cleaning unit 15 includes a cleaning brush or cleaning blade that slidingly contacts the surface of the photoreceptor drum 11 and removes any toner adhering to the photoreceptor drum 11 mechanically.

The development device 13 includes a development roller 13*a*, serving as a developer bearer, disposed close to the photoreceptor drum 11. In the portion where the development roller 13*a* faces the photoreceptor drum 11, a magnetic brush formed on the development roller 13*a* contacts the surface of the photoreceptor drum 11, thus forming a development range or development nip. The development device 13 contains two-component developer G including toner particles T (also "toner T") and carrier particles C (also "carrier C"). In the present embodiment, for example, concentration of toner in developer G is 7 percent by weight, and 225 grams of developer G is contained in the development device 13. The development device 13 develops the latent image formed on the photoreceptor drum 11 with the developer G into a toner image. The configuration and operation of the development device 13 are described in further detail later.

Referring to FIG. 1, the toner container 28 contains toner T to be supplied to the development device 13. For example, according to toner concentration (the ratio of toner in developer G) detected by a magnetic detector provided to the development device 13, toner T is supplied from the toner container 28 through a toner conveyance tube and via a supply inlet 13*e* (shown in FIG. 3) to the development device 13 as required.

It is to be noted that the data according to which toner T is supplied is not limited to toner concentration, and alternatively, toner T may be supplied according to toner consumption. For example, toner consumption may be determined based on the image density calculated from the reflectance of the toner image formed on the photoreceptor drum 11 or the intermediate transfer belt 17. Yet alternatively, toner T may be supplied according to a combination of such data.

The development device 13 is described in further detail below.

Referring to FIG. 2, the development device 13 includes the development roller 13*a* serving as the developer bearer, developer conveyance members 13*b*1 and 13*b*2 such as screw augers (hereinafter "first and second conveyance screws 13*b*1 and 13*b*2"), a doctor blade 13*c* serving as a developer regulator, and a partition 13*d*.

It is to be noted that the development device 13 and at least one of components oaf the image forming unit can be housed in a common unit casing, thus forming a process cartridge as described above. Alternatively, the development device 13 may be configured to be independently installed or removed from the image forming apparatus 1.

A development casing 13*k* contains the development roller 13*a*, and the first and second conveyance screws 13*b*1 and 13*b*2. An opening is formed in the development casing 13*k* such that the development roller 13*a* is exposed at the position facing the photoreceptor drum 11 (development range). The development casing 13*k* may be constituted of multiple separate components (e.g., upper and lower cases). An interior of the development casing 13*k* is divided, at least partly, by the partition 13*d* into first and second conveyance channels 31 and 32 in which the first and second conveyance screws 13*b*1 and 13*b*2 are provided, respectively.

The outer diameter of the development roller 13*a* is about 18 mm, for example. The development roller 13*a* includes a cylindrical sleeve 13*a*2 (shown in FIG. 3) formed of a non-magnetic material such as aluminum, brass, stainless steel, or conductive resin and is rotated counterclockwise in FIG. 2 at a velocity from 150 revolutions per minute (rpm) to 600 rpm by a driving unit, not shown.

Figure 3:
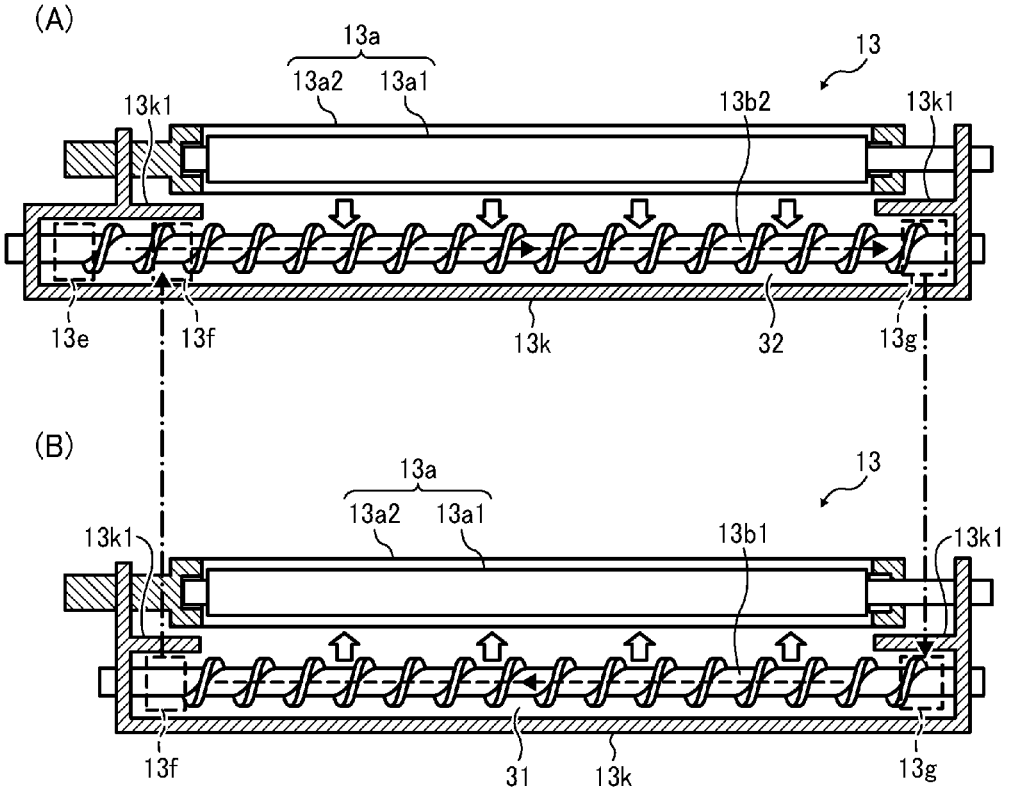
FIG. 3 schematically illustrates horizontal cross sections of the development device shown in FIG. 2, viewed in the longitudinal direction, and (A) and (B) respectively illustrate an upper portion and a lower portion of the development device.

FIG. 3 schematically illustrates horizontal cross sections of the development device 13, and (A) and (B) respectively illustrate an upper portion (where the second conveyance screw 13*b*2 is provided) and a lower portion (where the first conveyance screw 13*b*1 is provided) of the development device 13 in a longitudinal direction of the development device 13. It is to be noted that reference character 13*k*1 shown in FIG. 3 represents a guide portion.

Figure 4:
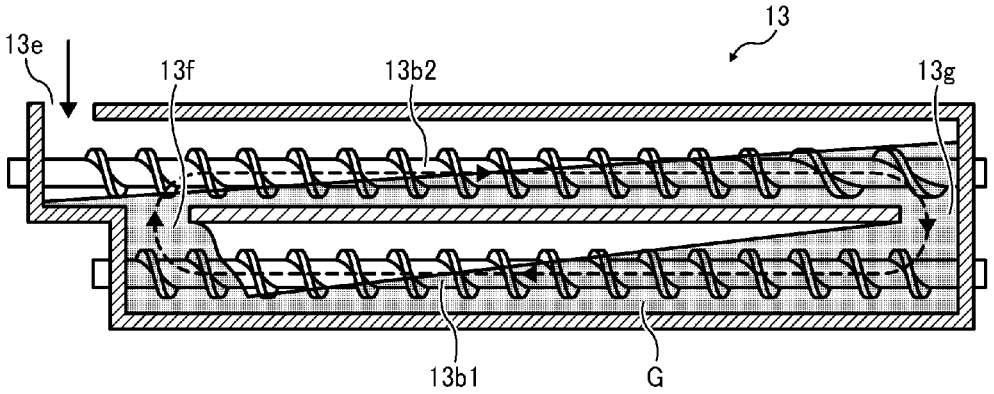
FIG. 4 illustrates a vertical cross section of the development device shown in FIG. 3, as viewed in the longitudinal direction.
Figure 5:
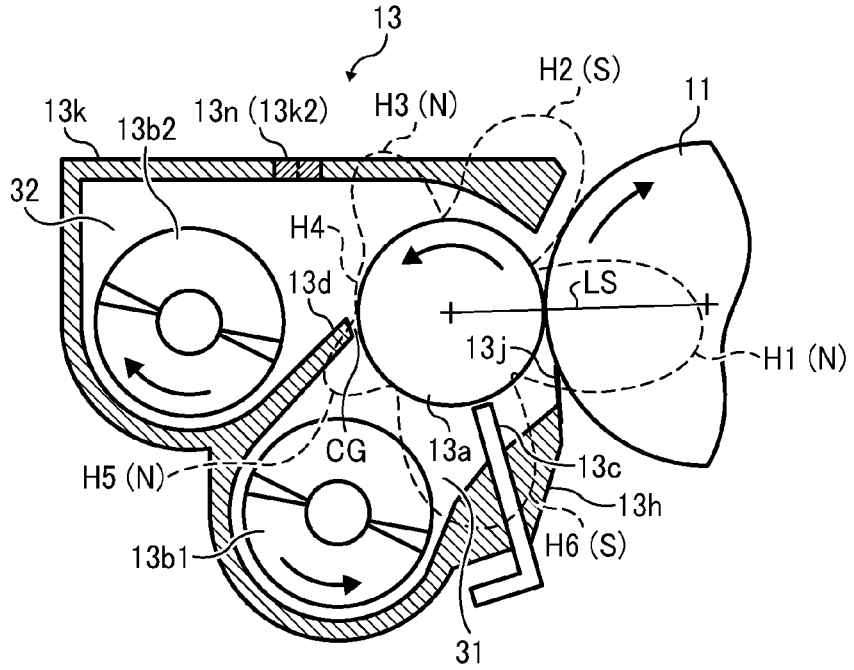
FIG. 5 is an end-on axial view illustrating a configuration of the development device.

FIG. 4 illustrates a vertical cross section of the development device 13 in the longitudinal direction. FIG. 5 illustrates a cross section of the development device 13 perpendicular to an axis of rotation of the development roller 13*a* with a distribution of magnetic force exerted by magnetic poles H1 through H6 on the development roller 13*a*.

Referring to FIGS. 3 and 5, a magnet 13*a*1 is provided inside the sleeve 13*a*2 and its position is fixed relative to the sleeve 13*a*2. The magnet 13*a*1 generates the multiple magnetic poles H1 through H6 around a circumferential surface of the sleeve 13*a*2. While the development roller 13*a* rotates in the direction indicated by the arrow shown in FIG. 2, the developer G carried on the circumferential surface thereof is transported to a position facing the doctor blade 13*c* (hereinafter "regulation gap"), where the amount of the developer G is adjusted, and is further transported to the development range facing the photoreceptor drum 11. Then, the toner in the developer G adheres to the latent image formed on the photoreceptor drum 11 due to the effect of the magnetic field generated in the development range.

As shown in FIG. 5, the magnetic pole (main pole) H1 is disposed facing the photoreceptor drum 11. The magnetic pole (transport pole) H2 is disposed downstream from the main pole H1 in the direction of rotation of the development roller 13*a* or the sleeve 13*a*2 and partly overlap an inner wall of the second conveyance channel 32. The magnetic pole (pre-release pole) H3 is disposed above the development roller 13*a* and downstream from the transport pole H2 in the direction of rotation of the development roller 13*a*. The magnetic pole (release pole) H4 is positioned between the magnetic pole H3 and H5 and above an end portion of the partition 13*d*. The magnetic pole H5 is positioned above the first conveyance channel 31, and the magnetic pole (attraction pole) H6 extends from a position facing the first conveyance screw 13*b*1 to a position adjacent to the doctor blade 13*c*. Hereinafter the attraction pole H6 is also referred to as "developer regulation pole".

Initially, the attraction pole H6 acts on the magnetic carrier particles in the developer and thus the developer G contained in the first conveyance channel 31 is carried on the development roller 13*a*. Then, the doctor blade 13*c* scrapes off the developer G partly from the circumferential surface of the development roller 13*a* to adjust the amount of the developer G carried thereon, and the scraped developer G is returned to the first conveyance channel 31. The developer particles G that have passed through the regulation gap between the doctor blade 13*c* and the circumferential surface of the development roller 13*a* stand on end on the development roller 13*a* due to the magnetic force exerted by the main pole H1, forming a magnetic brush in the development range, and slidingly contact the surface of the photoreceptor drum 11. Thus, the toner T in the developer G carried on the development roller 13*a* adheres to the latent image formed on the photoreceptor drum 11. The developer G that has passed through the development range is kept on the development roller 13*a* by the magnetic force exerted by the magnetic poles H2 and H3, and is transported to the position corresponding to the magnetic pole or release pole H4. Then, at a position corresponding to the release pole H4, magnetic repulsion (acting in the direction away from the development roller 13*a*) acts on the carrier particles, and thus the developer G used in the development process leaves the development roller 13*a*. Then, the developer G falls into the second conveyance channel 32 and transported downstream by the second transport screw 13*b*2 therein.

It is to be noted that, in FIG. 5, reference character LS represents a segment passing through the center of rotation of the development roller 13*a* and the center of rotation of the photoreceptor drum 11, and an angle from the segment LS counterclockwise to a center position in an area where magnetic force of the magnetic pole is half the peak is referred to as "a half-value center angle. For example, in the configuration shown in FIG. 5, the half-value center angle of the magnetic pole H1 is −5°, that of the magnetic pole H2 is 58°, that of the magnetic pole H3 is 120°, that of the magnetic pole H5 is 212°, and that of the magnetic pole H6 is 280°. Additionally, the peak magnetic forces of the magnetic poles H1, H2, H3, H5, and H6 are, for example, 100 mT, 85 mT, 52 mT, 35 mT, and 78 mT, respectively.

The magnetic poles H1 through H6 are generated by five magnetic poles magnetized to the magnet 13*a*1, and each of the five magnetic poles is either south (S) pole or north (N) pole as shown in FIG. 5. In other words, among the six magnetic poles H1 through H6, the magnetic pole H4 is not generated directly by the magnetic pole magnetized to the magnet 13*a*1 but is generated by two magnetic poles having an identical polarity (magnetic poles H3 and H5 whose polarity is N in the configuration shown in FIG. 5), between which the magnetic pole H4 is interposed.

The doctor blade 13*c* serving as the developer regulator is a nonmagnetic planer member disposed beneath the development roller 13*a*. The doctor blade 13*c* may be partly constituted of a magnetic material. In FIG. 2, the development roller 13*a* rotates counterclockwise, and the photoreceptor drum 11 rotates clockwise.

With this configuration, the development roller 13*a* can rotate in the forward direction relative to the photoreceptor drum 11 at the development range (development gap) in configurations in which the photoreceptor drums 11 are disposed beneath the intermediate transfer belt 17 to reduce the length of the sheet conveyance path and the horizontal size of the image forming apparatus 1. Accordingly, a sufficient development time in the development gap can be secured, increasing developing ability, compared with a configuration in which the doctor blade 13*c* is above the development roller 13*a* and the development roller 13*a* rotates in the counter direction relative to the photoreceptor drum 11.

It is to be noted that, although the first conveyance channel or supply path 31 in which the first conveyance screw 13*b*1 is provided is separated from the second conveyance channel or collecting channel 32 in which the second conveyance screw 13*b*2 is provided, the downstream end portion of the first conveyance channel 31 communicates with the upstream end portion of the second conveyance channel 32 through a first communication opening 13*f* (shown in FIG. 3). The downstream end portion of the second conveyance channel 32 in which the second conveyance screw 13*b*2 transports developer communicates with the upstream end portion of the first conveyance channel 31 through a second communication opening 13*g* (shown in FIG. 3). In the downstream end portion of the second conveyance channel 32, the developer G falls under its own weight through the second communication opening 13*g* to the upstream end portion of the first conveyance channel 31.

The first conveyance screw 13*b*1 and the second conveyance screw 13*b*2 agitate and mix the developer G contained in the development device 13 while transporting the developer G horizontally in the longitudinal direction or the axial direction, perpendicular to the surface of the paper on which FIG. 2 is drawn.

The first conveyance screw 13*b*1 is disposed facing the development roller 13*a* and supplies the developer G to the development roller 13*a* as indicated by hollow arrows shown in FIG. 3 at the position corresponding to the attraction pole H5 shown in FIG. 5 while transporting the developer G in the first conveyance channel 31 to the left in (B) of FIG. 3 as indicated by a broken arrow shown therein. The first conveyance screw 13*b*1 rotates counterclockwise in FIG. 2.

The second conveyance screw 13*b*2 is disposed above the first conveyance screw 13*b*1 and faces the development roller 13*a*. The second conveyance screw 13*b*2 transports the developer G that has left the development roller 13*a* (developer forced to leave the development roller 13*a* in the direction indicated by hollow arrow after image development) to the right in the second conveyance channel 32 as indicated by a broken arrow shown in (A) of FIG. 3. It is to be noted that, in the present embodiment, the second conveyance screw 13*b*2 is configured to rotate clockwise in FIG. 2, which is the opposite the direction of rotation of the development roller 13*a*.

The developer G transported from the downstream portion of the first conveyance channel 31 through the first communication opening 13*f* is transported by the second conveyance screw 13*b*2 downstream in the second conveyance channel 32, and is further transported from the second conveyance channel 32 to the upstream portion of the first conveyance channel 31 through the second communication opening 13*g* as indicated by a broken arrow shown in FIG. 3.

The first and second conveyance screws 13*b*1 and 13*b*2 are disposed so that their axes of rotation are substantially horizontal similarly to the development roller 13*a* and the photoreceptor drum 11. For example, each of the first and second conveyance screws 13*b*1 and 13*b*2 is formed of a screw shaft having a diameter of about 6 mm to 10 mm and a bladed screw spiral having an external diameter of about 20 mm and winding around the screw shaft with a screw pitch of about 40 mm (single or double thread). The rotational frequency of the first and second conveyance screws 13*b*1 and 13*b*2 may be about 600 rpm to 900 rpm.

In the first conveyance channel 31, the developer G that is not supplied to the development roller 13*a* accumulates adjacent to the first communication port 13*f* and then is transported through the first communication port 13*f* to the upstream end portion of the second conveyance channel 32.

It is to be noted that a paddle or screw winding in the opposite direction may be provided to a downstream portion of the first conveyance channel 31 (at a position facing the first communication port 13*f*) to facilitate conveyance of developer through the first communication port 13*f* (upward movement from the first conveyance channel 31 to the second conveyance channel 32 against the gravity).

With this configuration, a circulation channel through which the developer G is circulated in the longitudinal direction by the first and second conveyance screws 13*b*1 and 13*b*2 in the development device 13 is formed. That is, when the development device 13 is activated, the developer G contained therein flows in the developer circulation direction indicated by the broken arrows shown in FIGS. 3 and 4. Separating the first conveyance channel (supply channel) 31, in which the first conveyance screw 13*b*1 transports the developer G, from the second conveyance channel (collecting channel) 32, in which the developer G that has left the development roller 13*a* is collected and the second conveyance screw 13*b*2 is provided, can reduce unevenness in the density of toner image on the photoreceptor drum 11.

It is to be noted that the magnetic sensor (not shown) to detect the concentration of toner in the developer circulated in the development device 13 is disposed in the collecting channel (second conveyance channel) 32. Based on the toner concentration detected by the magnetic sensor, fresh toner T is supplied from the toner container 28 to the development device 13 through the supply inlet 13*e* disposed adjacent to the first communication port 13*f* in the collecting channel 32.

Additionally, referring to FIGS. 3 and 4, the supply inlet 13*e* is formed in an upper portion in the upstream portion of the collecting channel 32, away from the development range. That is, the supply inlet 13*e* is disposed outside the area occupied by the development roller 13*a* in the longitudinal direction. Disposing the supply inlet 13*e* close to the first communication port 13*f* is advantageous in that the used developer that has left the development roller 13*a* can fall on the supplied toner whose specific gravity is smaller and that the mixture is transported in the collecting channel 32 for a relatively long time. Accordingly, the supplied toner can be dispersed better in the developer.

It is to be noted that the position of the supply inlet 13*e* is not necessarily inside the collecting channel 32 but can be in an upper portion in the upstream portion of the supply channel 31, for example.

Additionally, referring to FIG. 4, the surface (i.e., level) of developer G in the first conveyance channel 31 gradually decreases downstream in the developer circulation direction except the adjacent area of the first communication port 13*f* because the first conveyance screw 13*b*1 supplies the developer G to the development roller 13*a* while transporting the developer G longitudinally. By contrast, the surface of developer G in the second conveyance channel 32 increases downstream because the second conveyance screw 13*b*2 collects the developer that has left the development roller 13*a* while transporting the developer longitudinally.

As shown in FIG. 5, in the development device 13 according to the present embodiment, the partition 13*d* (planar separator) is disposed facing the development roller 13*a* and separates the first conveyance channel 31 from the second conveyance channel 32. In other words, the partition 13*d* is provided at a position facing the development roller 13*a* and between the first conveyance channel 31 and second conveyance channel 32 to inhibit the developer that has left the development roller 13*a* from being carried on the development roller 13*a*.

Specifically, the partition 13*d* serves as a wall for separating the first conveyance channel 31 from the second conveyance channel 32 and projects toward the development roller 13*a* from the development casing 13*k*. The partition 13*d* is integrated or continuous with the development casing 13*k* (indicated by hatching in FIG. 2). For example, a clearance CG (shown FIG. 5) of less than 2 mm (more preferably, within a range of 0.1 mm to 0.5 mm) is provided between the development roller 13*a* and an end face of the partition 13*d* facing the development roller 13*a*. In the present embodiment, the clearance CG is about 0.3 mm.

Forming the partition 13*d* with a nonmagnetic material is advantageous in that the partition 13*d* does not magnetically attract magnetic carrier particles, thus inhibiting blockage of flow of developer inside the second conveyance channel 32. Further, it does not unnecessarily promote movement of developer toward the first conveyance channel 31.

Additionally, in the present embodiment, the size of a clearance (casing gap) between an upper portion of the development casing 13*k* (downstream from the development range) and the development roller 13*a* is within a range of from about 1.2 mm to 2.0 mm. With this configuration, developer particles standing on end on the development roller 13*a* (after image development) are transported while sliding on the development casing 13*k* to seal the casing gap. Accordingly, a sucking-in airflow flowing into the development device 13 can be generated, inhibiting developer particles from scattering outside the development device 13.

Referring to FIG. 5, a retainer 13*h* is provided at a position facing the doctor blade 13*c* from outside (upstream from the development range). The retainer 13*h* can serve as a cover for covering the doctor blade 13*c*. Additionally, a flexible entrance seal 13*j* is attached or bonded to the retainer 13*h*. Specifically, the entrance seal 13*j* is disposed facing the photoreceptor drum 11 and can be formed of polyurethane resin or the like, for example. The entrance seal 13*j* contacts the photoreceptor drum 11 with a relatively small pressure and is designed to alleviate scattering of developer (toner) from the development device 13 upstream from the development range.

Additionally, a through hole 13*k*2 is formed in the development casing 13*k* as shown in FIG. 5. In FIG. 5, reference character 13*n* represents a seal member.

Next, developer used in the present embodiment is described below.

The toner T (a component of developer G) usable in the present embodiment is polymerized toner and includes binder resin. Examples of the binder resin include styrene resin (single polymer or copolymer that includes styrene or styrene substitution product) such as styrene-acrylonitrile-acrylate copolymer, polyester resin, epoxy resin, and compounds thereof. Such polymerized toners can be produced using bulk polymerization, solution polymerization, emulsion polymerization, or suspension polymerization.

As an external additive, inorganic fine particles are preferable. For example, 1.0 weight percent of silica and 0.5 weight percent of titanium oxide may be used. As a release agent, oxide of rice wax, low-molecular polypropylene wax, or carnauba wax may be used. Additionally, a charge controlling agent may be included.

The toner T used in the present embodiment is small-diameter toner having a volume average particle diameter of about 5.8 μm or smaller. In the toner T, percentage by number of particles having a diameter of 5 μm or smaller is 60% to 80%.

It is to be noted that pulverized toner can be used instead of polymerized toner.

The carrier C in the developer G used in the present embodiment is small-diameter carrier having a weight average particle diameter of within a range from 20 μm to 60 μm. For example, weight average particle diameter of carrier C is 35 μm in the present embodiment.

For example, the carrier C includes a ferrite particle as a core and, and the core particle is coated with 0.5 μm of methylmethacrylate (MMA) resin to have the above-described particle diameter. Alternatively, coated carrier having a magnetite core may be used.

Use of small-diameter carrier can enhance density uniformity of solid images or halftone image quality. Additionally, small-diameter carrier can enhance coating rate of toner for coating carrier and is good with small-diameter toner suitable for high image quality.

Figure 6:
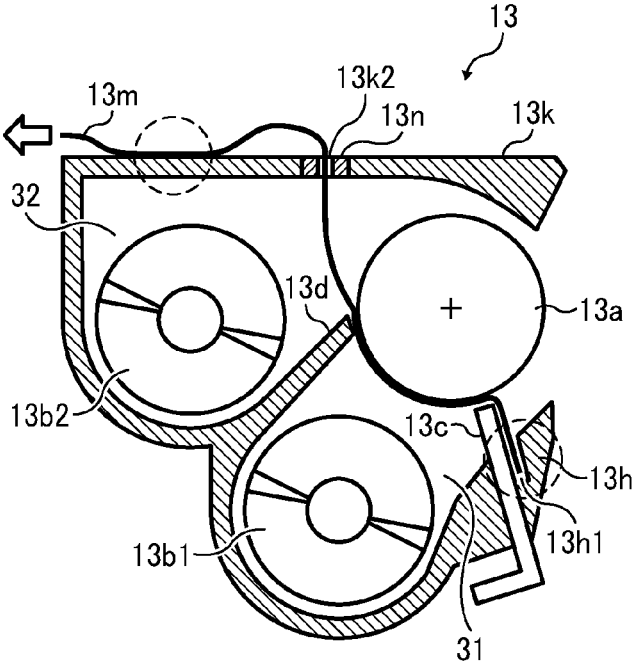
FIG. 6 is an end-on axial view illustrating the development device at the time of shipment.

Distinctive features of the development device 13 according to the present embodiment are described below. FIG. 6 is an end-on axial view of the development device 13 at the time of shipment (before use).

Referring to FIG. 6, the development device 13 according to the present embodiment further includes a sheet member 13*m* removably provided to cover the surface of the development roller 13*a* in an area (hereinafter "sealing area") facing the doctor blade 13*c*, the first conveyance channel 31, the partition 13*d*, and second conveyance channel 32. One end (first end) portion of the sheet member 13*m* extending from a position facing the second conveyance channel 32 penetrates the through hole 13*k*2 formed in the development casing 13*k* and is disposed outside the development casing 13*k*. The other end (second end) portion of the sheet member 13*m* extending from a position facing the doctor blade 13*c* is held by the retainer 13*h* from the outer side (on the right in FIG. 6) of the doctor blade 13*c* relative to the sealing area.

More specifically, the sheet member 13*m* is disposed in contact with about one fourth of the outer circumference of the development roller 13*a*, thus extending about 90 degrees of the development roller 13*a* in the circumferential direction. The first end portion of the sheet member 13*m* draws a gentle curve from the partition 13*d* to the through hole 13*k*2 (with a curvature smaller than that of the development roller 13*a*), and a portion of the sheet member 13*m* exposed from the development casing 13*k* (enclosed with broken circle in FIG. 6) is removably bonded to an outer surface of the development casing 13*k* using glue or thermal welding such that it can be manually removed easily. The second end portion of the sheet member 13*m* (enclosed with broken circle in FIG. 6) is retained between the doctor blade 13*c* and the retainer 13*h*.

Additionally, the seal member 13*n* is provided to a rim of the through hole 13*k*2 formed in the development casing 13*k* to fill in the clearance between the sheet member 13*m* and the rim of the through hole 13*k*2. The seal member 13*n* may be bonded to the rim. Specifically, the seal member 13*n* is formed of a elastic material, for example, foamed polyurethane, and a cutout (in FIG. 6, a clearance is illustrated for ease of understanding) is formed in a center portion of the seal member 13*n* into which the sheet member 13*m* is inserted to seal the development casing 13*k*.

Additionally, the doctor blade 13*c* is fixed at a lower portion of the development casing 13*k* such that the regulation gap (the clearance between the doctor blade 13*c* and the surface of the development roller 13*a*) is adjustable, and the retainer 13*h* is attached to the doctor blade 13*c* with screws, snap-on retainers (clips or pins), or the like. Additionally, a recess 13*h*1 (in FIG. 6, a clearance is illustrated for ease of understanding) is formed in the retainer 13*h* to interpose the second end of the sheet member 13*m* between the doctor blade 13*c* and the retainer 13*h*. The second end portion of the sheet member 13*m* is retained in the recess 13*h*1 of the retainer 13*h* so that it can be manually pulled out easily.

Thus, the area of the surface of the development roller 13*a* facing the doctor blade 13*c*, the first conveyance channel 31, the partition 13*d*, and the second conveyance channel 32 can be covered with the sheet member 13*m*, and the area sealed by the sheet member 13*m* can be relatively small.

The sheet member 13*n* serving as a seal member is removed at the site of users before the development device 13 is used. The first end portion of the sheet member 13*m* is exposed above the development device 13 for the user or service person to grip it. The user grips the first end portion of the sheet member 13*m* with hand and pulls the sheet member 13*m* in the direction indicated by arrow shown in FIG. 6, thereby removing it from the development device 13.

The sheet member 13*m* is a thin flexible sheet formed of, for example, polyurethane resin, and provided to cover the development roller 13*a* from the position of the doctor blade 13*c* to the second conveyance channel 32, thereby separating the development roller 13*a* from the interior of the development device 13.

The sheet member 13*m* is installed in the development device 13 before shipment as shown in FIG. 6. That is, the sheet member 13*m* is installed in the development device 13 at factory after the regulation gap is adjusted and developer is contained in the first and second conveyance channels 31 and 32.

More specifically, after developer is contained in the development device 13, the second end portion of the sheet member 13*m* is inserted into the through hole 13*k*2, pushed so that it follows the shape of the development roller 13*a*, and caused to exit from the regulation gap. The second end portion of the sheet member 13*m* emerging from the regulation gap is clamped by the retainer 13*h*. Then, while keeping the sheet member 13*m* taut to have a predetermined tension, the first end portion of the sheet member 13*m* is partly fixed to an upper portion of the development casing 13*k* by thermal welding or the like.

Figure 7A:
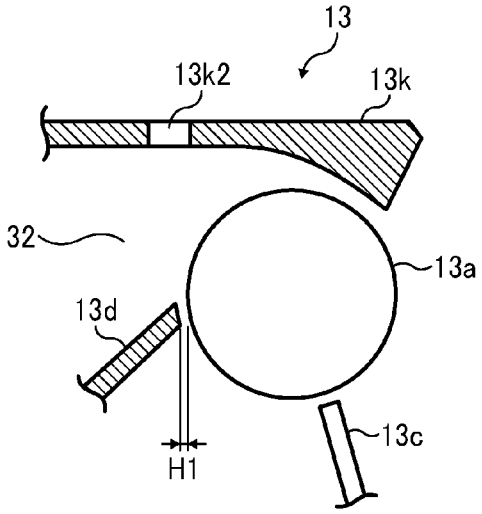
FIG. 7A is an end-on axial view illustrating a longitudinal center portion of the development device.
Figure 7B:
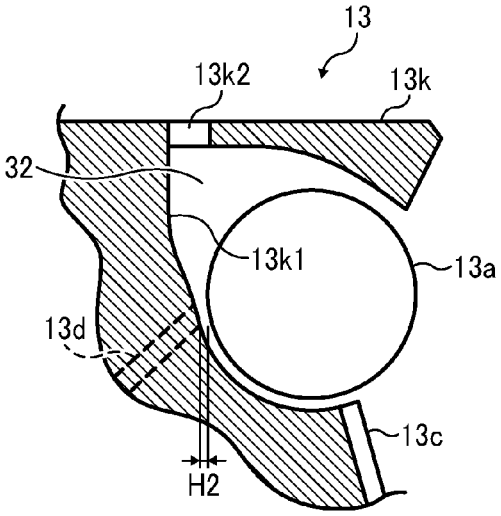
FIG. 7B is an end-on axial view illustrating a longitudinal end portion of the development device.

FIG. 7A is an end-on axial view illustrating a longitudinal center portion of the development device 13, and FIG. 7B is an end-on axial view illustrating a longitudinal end portion of the development device 13.

In the present embodiment, as shown in FIGS. 3 and 7B, the guide portion 13*k*1 is provided in either axial end portion of the development casing 13*k* and serves as a guide wall. The guide portion 13*k*1 is disposed across a clearance from the circumferential surface of the development roller 13*a* in the area facing the doctor blade 13*c*, the first conveyance channel 31, the partition 13*d*, and the second conveyance channel 32.

Specifically, in the area extending from the position adjacent to the doctor blade 13*c* through the first conveyance channel 31 to the position adjacent to the partition 13*d*, the guide portion 13*k*1 is concentric with the outer circumference of the development roller 13*a* across a predetermined clearance H2 from the circumference of the development roller 13*a*. In the area from the position adjacent to the partition 13*d* through the second conveyance channel 32 to the through hole 13*k*2, the guide portion 13*k*1 draws a gentle curve (with a curvature smaller than that of the development roller 13*a*) so that the distance from the development roller 13*a* increases gradually.

With the guide portions 13*k*1 provided in the respective axial end portions, in installation of the sheet member 13*m* in the development device 13 at factory, the sheet member 13*m* can move from the through hole 13*k*2 to the regulation gap, being guided by the guide portion 13*k*1. Thus, installation of the sheet member 13*m* can be facilitated significantly. Further, at the user's site, when the user pulls out the sheet member 13*m* from the development device 13, movement of the sheet member 13*m* from the regulation gap to the through hole 13*k*2 can be also guided by the guide portion 13*k*1, thus making the work of the user easier.

In particular, as shown in FIGS. 7A and 7B, the clearance H2 between the guide portion 13*k*1 and the development roller 13*a* is similar in size to a clearance H1 between the partition 13*d* and the development roller 13*a* (H1≈H2), that is, the distance between the guide portion 13*k*1 and the development roller 13*a* is similar to the distance between the partition 13*d* and the development roller 13*a*, at least in an area adjacent to the partition 13*d* in the present embodiment.

With this configuration, when the sheet member 13*m* is installed or removed from the development device 13, the guide portions 13*k*1 in the axial end portions can guide the sheet member 13*m*, thereby inhibiting a center portion of the sheet member 13*m* in the longitudinal direction from being caught by the partition 13*d*.

It is to be noted that, the guide portions 13*k*1 are disposed outside the development range on the development roller 13*a* (outside the magnet 13*a*1 in the longitudinal direction of the development roller 13*a*) as shown in FIG. 3, and this arrangement can inhibit developer from entering between the guide portion 13*k*1 and the development roller 13*a*. That is, this arrangement causes neither increases in the driving torque of the development device 13, degradation in conveyance of developer, nor adverse effects on output images.

It is to be noted that, although the sheet member 13*m* is inserted into the through hole 13*k*2 from the second end in the description above, alternatively, the sheet member 13*m* may be inserted in the regulation gap from the first end. Also in this case, the sheet member 13*m* being pushed toward the through hole 13*k*2 can follow the guide portion 13*k*1. Thus, the sheet member 13*m* can be installed smoothly in the development device 13 after assembling of the device and adjustment of the regulation gap are completed.

Then, the sheet member 13*m* covering a part of the development roller 13*a* can serve as a seal member for preventing leakage of developer that is contained in the development device 13 before shipment. This configuration can inhibit developer preliminarily contained in the development device 13 from scattering, adhering to the development roller 13*a* or the photoreceptor drum 11, and giving damage to the development roller 13*a* or the photoreceptor drum 11 during transportation. As described above, the sheet member 13*m* is removed from the development device 13 at the user's site.

It is to be noted that, the seal member 13*n* is provided to the through hole 13*k*2, through which the sheet member 13*m* is removed, and the elastic seal member 13*n* can deform to fill in the through hole 13*k*2 after the sheet member 13*m* is removed. Therefore, leakage of developer from the through hole 13*k*2 can be prevented regardless of the presence of the sheet member 13*m*.

Additionally, even if the surface of the sheet member 13*m* is stained with developer contained inside the development device 13, the developer can be scraped off from the sheet member 13*m* through the cutout formed in the seal member 13*n* during removal of the sheet member 13*m* from the development device 13. Therefore, hands of the person removing the sheet member 13*m* can be kept clean.

As described above, in the present embodiment, the first end portion of the sheet member 13*m* is exposed above the development casing 13*k* and is designed to be pulled by hand in removal of the sheet member 13*m*.

The arrangement in which the position at which the sheet member 13*m* is pulled out is disposed not the lower portion (upstream from the development range) but the upper portion of the development device 13 (downstream from the development range) as in the configuration shown in FIG. 6 is advantageous in that the sheet member 13*m* being removed does not interfere with the entrance seal 13*j*. Accordingly, performance of the entrance seal 13*j* can be maintained.

Additionally, since the sheet member 13*m* serving as a seal member extends over the entire axial length of development roller 13*a*, clearance between the development roller 13*a* and the development casing 13*k* or the doctor blade 13*c* can be sealed entirely in the longitudinal direction. Accordingly, the above-described effects of the sheet member 13*m* can be secured.

Additionally, the second end of the sheet member 13*m*, which is on the trailing side in the direction of removal, is simply caught between the retainer 13*h* and the doctor blade 13*c* and is not glued or bonded using double-sided adhesive tape. This configuration can eliminate the possibility that a part of glue or double-sided adhesive tape falls from the sheet member 13*m* in removal of the sheet member 13*m* and is mixed in the developer contained in the development device 13.

It is preferred that at least the second end portion (trailing side in the direction of removal) of the sheet member 13*m* be formed of a flexible material and that the material forming the second end portion should have a lower frictional property or relatively low coefficient of friction. With such properties, in removal of the sheet member 13*m* from the development device 13, damage to the photoreceptor drum 11 or the development roller 13*a* resulting from sliding contact between such components and the second end portion of the sheet member 13*m* can be prevented or reduced.

Figure 8:
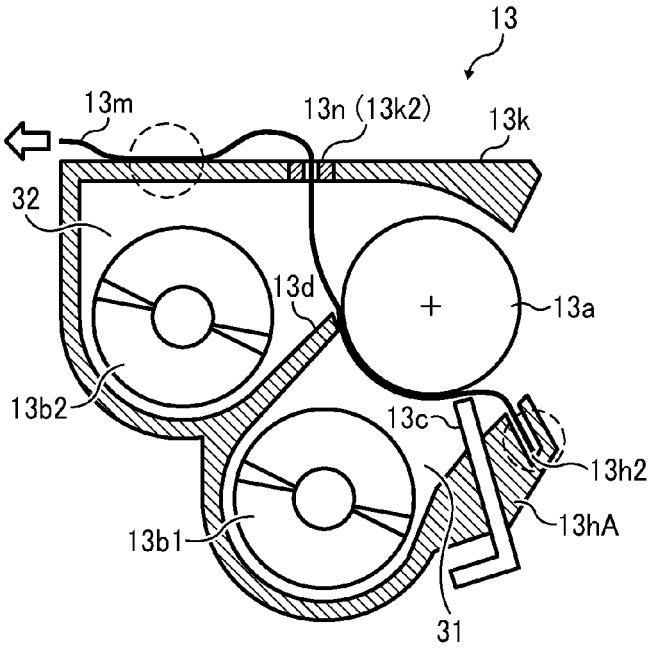
FIG. 8 is an end-on axial view illustrating a development device according to a variation of the configuration shown in FIG. 6 at the time of shipment.

FIG. 8 illustrates a development device according to a variation of the configuration shown in FIG. 6.

Although the second end portion of the sheet member 13*m* is caught between the doctor blade 13*c* and the retainer 13*h* in the above-described embodiment, in the configuration shown in FIG. 8, the second end portion of the sheet member 13*m* is held only by a retainer 13*h*A at a position outside the doctor blade 13*c*.

Referring to FIG. 8, the doctor blade 13*c* is fixed at a lower portion of the development casing 13*k* such that the regulation gap (the clearance between the doctor blade 13*c* and the development roller 13*a*) is adjustable, and the retainer 13*h*A is attached to the doctor blade 13*c* with screws, snap-on retainers (clips or pins), or the like. A recess 13*h*2 (clearance is illustrated in FIG. 8 for ease of understanding) into which the second end of the sheet member 13*m* is inserted is formed in the retainer 13*h*A. The recess 13*h*2 is positioned facing the development roller 13*a*. The second end portion of the sheet member 13*m* is retained in the recess 13*h*2 of the retainer 13*h*A so that it can be manually pulled out easily.

In such a configuration, similar effects can be also attained.

The above-described embodiment is designed such that, in the configuration in which the multiple conveyance screws 13*b*1 and 13*b*2 (developer conveyance members) are arranged vertically and facing the development roller 13*a* (developer bearer), the sheet member 13*m* for covering the surface of the development roller 13*a* in the area facing the doctor blade 13*c*, the first conveyance channel 31, the partition 13*d*, and the second conveyance channel 32 can be removably installed with a relatively small sealing area. This configuration can inhibit developer preliminarily contained in the development device 13 from scattering outside the development device 13, adhering to the development roller 13*a* or the photoreceptor drum 11, and giving damage to the development roller 13*a* or the photoreceptor drum 11 during transportation.

It is to be noted that, although developer is contained and the sheet member 13*m* is installed in the development device 13 at factory in the description above, alternatively, developer and the sheet member 13*m* may be set in the development device 13 at a service station before delivery to users.

Additionally, the number of the developer conveyance members (e.g., conveyance screws) is not limited to two but can be equal to or greater than three as long as at least two of them are disposed facing the development roller 13*a*.

Additionally, in the description above, the second conveyance screw 13*b*2 serving as the collecting screw is disposed above the second conveyance screw 13*b*1 serving as the supply screw, and the doctor blade 13*c* is disposed beneath the development roller 13*a*. However, the configurations to which the features of the present invention are applicable are not limited thereto but can include configurations in which the collecting screw is disposed beneath the supply screw, and the doctor blade 13*c* is disposed above the development roller 13*a*.

Also, the number of magnetic poles (e.g., H1 through H6) formed around the development roller 13*a* is not limited to six but can be less or greater than six. The sheet member 13*m* can be installed also in such configurations, attaining similar effects.

Additionally, although only fresh toner is supplied from the toner container 28 to the development device 13 in the description above, alternatively, premixed fresh developer including toner and carrier may be supplied from a developer container to the development device 13. In this configuration, the development device 13 may further include a member to discharge excessive developer or used developer from the development device 13. In such a configuration, similar effects can be also attained.

Numerous additional modifications and variations are possible in light of the above teachings. The number, position, and shape of the components of the image forming apparatus described above are not limited to those described above. It is therefore to be understood that, within the scope of the appended claims, the disclosure of this patent specification may be practiced otherwise than as specifically described herein.

What is claimed is:

1. A development device to develop a latent image formed on a latent image bearer with two-component developer including toner and carrier, the development device comprising:

a development casing for containing developer;

a developer bearer disposed facing the latent image bearer through an opening formed in the development casing;

a developer regulator disposed facing the developer bearer;

a first developer conveyance member disposed facing the developer bearer;

a second developer conveyance member disposed facing the developer bearer;

a partition disposed facing the developer bearer and dividing an interior of the development casing into first and second conveyance channels in which the first and second developer conveyance members are respectively provided, forming a developer circulation channel, the first and second conveyance channels both facing the developer bearer and extending in an axial direction of the developer bearer;

a sheet member removably installable inside the development casing to cover a surface of the developer bearer in an area facing the developer regulator, the first and second conveyance channels, and the partition, the sheet member including a first end portion extending from a position facing the second conveyance channel outside the development casing through a through hole formed in the development casing and extending outside of the development casing, and a second end portion extending from a position facing the developer regulator, wherein the through hole is located in a side of the development casing other than where the opening is located; and a retainer to retain the second end portion of the sheet member at a position outside the developer regulator.

2. The development device according to claim 1, wherein developer and the sheet member are preliminarily set inside the development casing before delivery to a user, and the sheet member is removed from the development casing before use of the development device.

3. The development device according to claim 1, wherein a guide wall is provided in either one of the axial end portions of the development casing in the axial direction of the developer bear, the guide wall being disposed across a clearance from the surface of the developer bearer in the area facing the developer regulator, the first and second conveyance channels, and the partition.

4. The development device according to claim 3, wherein a distance between the guide wall and the developer bearer is substantially equal to a distance between the partition and the developer bearer at least in an area adjacent to the partition.

5. The development device according to claim 3, wherein, on a cross section perpendicular to the axial direction of the developer bearer, the guide wall is concentric with an outer circumference of the developer bearer in an area extending from a position adjacent to the developer regulator through the first conveyance channel to the position adjacent to the partition.

6. The development device according to claim 5, wherein the guide wall is shaped to have a curvature smaller than a curvature of the developer bearer such that a distance from the developer bearer to the guide wall increases from the position adjacent to the partition toward the through hole formed in the development casing.

7. The development device according to claim 1, wherein at least the second end portion of the sheet member is constituted of a flexible material.

8. The development device according to claim 1, wherein at least the second end portion of the sheet member is constituted of a material having a coefficient of friction such that damage to the surface of the developer bear is prevented.

9. The development device according to claim 1, further comprising a sealing member to fill in a clearance between the first end portion of the sheet member and a rim enclosing the through hole formed in the development casing, wherein the second end portion of the sheet member is retained between the developer regulator and the retainer, and the first end portion of the sheet member is partly bonded to an outer face of the development casing to be gripped by a user in removal of the sheet member from the development device.

10. The development device according to claim 1, wherein a recess in which the second end portion of the sheet member is fitted is formed in the retainer, and the retainer is attached to the developer regulator with the second end portion of the sheet member interposed between the developer regulator and the retainer.

11. A process cartridge removably installed in an image forming apparatus, the process cartridge comprising:

the latent image bearer; and the development device according to claim 1.

12. A process cartridge in an image forming apparatus, the process cartridge comprising:

the development device according to claim 1.

13. The process cartridge according to claim 12, further comprising a sealing member to fill in a clearance between the first end portion of the sheet member and a rim enclosing the through hole formed in the casing, wherein the second end portion of the sheet member is retained between the regulator and the retainer, and the first end portion of the sheet member is partly bonded to an outer face of the casing to be gripped by a user in removal of the sheet member from the development device.

14. The process cartridge according to claim 13, wherein a recess in which the second end portion of the sheet member is fitted is formed in the retainer, and the retainer is attached to the regulator with the second end portion of the sheet member interposed between the regulator and the retainer.

15. The development device of claim 1, wherein the through hole in the development casing is oriented in a direction different from a direction of the opening in the development device.

16. The development device according to claim 1, further comprising a seal that contacts a surface of the latent image bearer, wherein the retainer retains the second end portion of the sheet member at a position inside the seal and outside the developer regulator.

17. An image forming apparatus comprising:

a latent image bearer; and a development device to develop a latent image formed on the latent image bearer with two-component developer including toner and carrier, the development device including:

a development casing;

a developer bearer disposed facing the latent image bearer through an opening formed in the development casing;

a developer regulator disposed facing the developer bearer;

a first developer conveyance member disposed facing the developer bearer;

a second developer conveyance member disposed facing the developer bearer;

a partition disposed facing the developer bearer and dividing an interior of the development casing into first and second conveyance channels in which the first and second developer conveyance members are respectively provided, forming a developer circulation channel, the first and second conveyance channels both facing the developer bearer and extending in an axial direction of the developer bearer;

a sheet member removably installable inside the development casing to cover a surface of the developer bearer in an area facing the developer regulator, the first and second conveyance channels, and the partition, the sheet member including a first end portion extending from a position facing the second conveyance channel outside the development casing through a through hole formed in the development casing and extending outside of the development casing, and a second end portion extending from a position facing the developer regulator, wherein the through hole is located in a side of the development casing other than where the opening is located; and a retainer to retain the second end portion of the sheet member at a position outside the developer regulator.

18. A development device to develop a latent image formed on a latent image bearer with two-component developer including toner and carrier, the development device comprising:

a development casing for containing developer;

a developer bearer disposed facing the latent image bearer through an opening formed in the development casing, a developer regulator disposed facing the developer bearer;

a first developer conveyance member disposed facing the developer bearer;

a second developer conveyance member disposed facing the developer bearer;

a partition disposed facing the developer bearer and dividing an interior of the development casino into first and second conveyance channels in which the first and second developer conveyance members are respectively provided, forming a developer circulation channel, the first and second conveyance channels both facing the developer bearer and extending in an axial direction of the developer bearer;

a sheet member removably installable inside the development casing to cover a surface of the developer bearer in an area facing the developer regulator, the first and second conveyance channels, and the partition, the sheet member including a first end portion extending from a position facing the second conveyance channel outside the development casing through a through hole formed in the development casing and extending outside of the development casing, and a second end portion extending from a position facing the developer regulator, wherein the through hole is not located in the same side of the development casing as the opening; and a retainer to retain the second end portion of the sheet member at a position outside the developer regulator.

* * * * *